US009144835B2

(12) United States Patent
Houle et al.

(10) Patent No.: US 9,144,835 B2
(45) Date of Patent: Sep. 29, 2015

(54) TUBE AND PIPE BENDERS AND METHODS OF BENDING SAME

(75) Inventors: Joseph J. Houle, Westfield, MA (US); David Wortelboer, Springfield, MA (US)

(73) Assignee: Irwin Industrial Tool Company, Huntersville, NC (US)

( * ) Notice: Subject to any disclaimer, the term of this patent is extended or adjusted under 35 U.S.C. 154(b) by 604 days.

(21) Appl. No.: 13/426,489

(22) Filed: Mar. 21, 2012

(65) Prior Publication Data

US 2012/0240655 A1 Sep. 27, 2012

Related U.S. Application Data

(60) Provisional application No. 61/454,891, filed on Mar. 21, 2011.

(51) Int. Cl.
*B21D 7/06* (2006.01)

(52) U.S. Cl.
CPC ..... *B21D 7/063* (2013.01); *Y10T 29/49716* (2015.01)

(58) Field of Classification Search
CPC ..... B21D 7/02; B21D 7/021; B21D 7/063; B21D 7/04; B21D 7/00; B21D 7/022; B21D 7/06
USPC ..... 72/389.2, 390.2, 462, 476
See application file for complete search history.

(56) References Cited

U.S. PATENT DOCUMENTS 2,223,015 A * 11/1940 Hathorn ..... 72/150
2,387,511 A 10/1945 Henry et al.
2,406,838 A * 9/1946 Kepler ..... 72/369
3,472,056 A 10/1969 Gregg
4,379,399 A * 4/1983 Kowal ..... 72/388
4,989,441 A 2/1991 Wagner
5,105,646 A 4/1992 Koskinen
5,142,895 A * 9/1992 Schuchert ..... 72/150
5,461,897 A 10/1995 Gray et al.
5,528,921 A 6/1996 Herman
5,615,572 A 4/1997 Johnson et al.

(Continued)

FOREIGN PATENT DOCUMENTS

EP 2 106 864 A2 10/2009

OTHER PUBLICATIONS http://www.rothenbergertools.us/44.html, "Rothernberger Mini Bender & Tube Bender MAXI", © 2008 CSC Industrial.

(Continued)

*Primary Examiner* — Teresa M Ekiert
(74) *Attorney, Agent, or Firm* — Sutherland Asbill & Brennan LLP

(57) ABSTRACT

In a crossbow-style tube bender, a curved bending mandrel having a channel into which the tube in bent to form the bent tubing length has at least one relief surface forming a localized recess or depression in the surface of the channel. A forming bar or cross bar adapted to cooperate with a bending mandrel has on a first side of the forming bar a least one first pair of forming mandrels configured for a first tubing size, and on a second side of the forming bar has at least one second pair of forming mandrels configured for a second tubing size. The bender has a quick connect-disconnect mechanism permitting quick disconnection from and connection to the forming bar to utilize either the at least one first or at least one second pairs of forming mandrels.

19 Claims, 7 Drawing Sheets

(56) References Cited

U.S. PATENT DOCUMENTS

| | | | |
|---|---|---|---|
| 5,724,852 | A | 3/1998 | Lee |
| 5,761,950 | A | 6/1998 | Chiu |
| 5,921,132 | A | 7/1999 | Froehlich |
| 6,393,950 | B1 | 5/2002 | Crosser |
| 6,523,388 | B1 | 2/2003 | Winston, III |
| 6,644,087 | B1 | 11/2003 | Ralph et al. |
| 6,931,908 | B1 | 8/2005 | Mitson |
| 7,412,867 | B2 | 8/2008 | Boulin |
| D596,004 | S | 7/2009 | Picaza Ibarrondo |
| 7,624,612 | B2 | 12/2009 | Toda et al. |
| 2004/0216566 | A1 | 11/2004 | Shih |
| 2004/0250599 | A1 | 12/2004 | Shed |

OTHER PUBLICATIONS

"Ratchet Hand Tube Bender ", Yellow Jacket HVAC&R Service Tools, © 2011 Ritchie Engineering Company, Inc., p. 85, Edition 62, Bloomington, MN.

International Search Report and Written Opinion of the International Searching Authority for International Application No. PCT/US12/30008, mailed Aug. 9, 2012.

* cited by examiner

TUBE AND PIPE BENDERS AND METHODS OF BENDING SAME

CROSS-REFERENCE TO RELATED APPLICATIONS

The patent application claims benefit under 35 U.S.C. §119 (e) to U.S. provisional application Ser. No. 61/454,891, filed Mar. 21, 2011, titled "Tube and Pipe Benders and Methods of Bending Same", which is hereby expressly incorporated by reference as part of the present disclosure.

FIELD OF THE INVENTION

The present invention relates to tube benders, and more particularly, relates to "crossbow-style" benders.

BACKGROUND INFORMATION

Crossbow-style benders are used to bend tubing or piping for a variety of applications. Crossbow benders are helpful in achieving the desired bend angle with accuracy. However, the inventors have discerned a number of disadvantages of previously known crossbow benders.

One disadvantage is that such benders are difficult to set-up and operate. To accommodate different tubing or piping sizes, shapes and bend radii, the forming bar, which acts against the side of the tubing opposite the mandrel, must be changed or adjusted for the particular tubing to be bent. Typically, hand-operated benders utilize two or more forming bars. For example, one forming bar may be utilized for ¼"-⅜" tubing, and another forming bar for ½"-⅞". The forming bar is typically attached to the bender by a screw or bolt. To change out forming bars, the user must remove the screw or bolt to remove the attached forming bar, and then screw or bolt on the other forming bar.

This procedure to switch out forming bars can be time-consuming and cumbersome. In addition, as only one of the forming bars is attached to the bender, the other forming bar(s) may become lost or difficult to find in a toolbox, which may be full of different tools. Further, it may be unclear or not easy to identify which forming bar is to be utilized with particular tubing.

A bender sold by Rothenberger USA of Rockford, Ill. addresses the use of multiple forming bars. The Rothenberger device utilizes one forming bar for a range of tubing sizes. However, the forming mandrels on the forming bar must be removed from the bar and repositioned to different locations on the bar for different tubing sizes. Thus, the Rothenberger device still requires time-consuming and cumbersome rearrangement of the mechanism.

Another problem identified in previous crossbow benders is that, after bending, the tube can be difficult to remove from the bending mandrel. This occurs, at least in part, due to cross-sectional deformation of the tubing during bending. Not only does removing a tube that is "stuck" in the bending mandrel take time and effort, but the force required to remove or unstick the bent tube can damage or distort the tube, or alter the bend or shape of the tube, which is undesirable. This is particularly so if tools are required, e.g., a hammer or pliers, to remove the tube.

SUMMARY OF THE INVENTION

Accordingly, it is an object of the present invention to overcome one or more of the above-described drawbacks and/or disadvantages of the prior art.

The present invention is directed to a bender that can be utilized for bending tubing for plumbing, heating, cooling, and HVAC applications. The bender includes a base portion adapted to engage a bending mandrel configured for bending a tube of a particular size or configuration into a desired shape or bend. The bender further includes a holding portion configured to engage a forming bar containing at least one pair of forming mandrels adapted to cooperate with the bending mandrel to bend the tube. The bender additionally includes an actuator to move the bending mandrel and forming bar relative to each other so as to bend the tube.

In one aspect, the bending mandrel includes a curved channel configured to receive at least a portion of a tube and generally defines a bend profile of the tube, such that when the tube portion is deformed into the channel by the bender, the portion of the tube generally conforms to the configuration of the channel. The surface of the channel generally conforms to the outer surface of the tube to engage the tube during bending. In some embodiments, the channel includes a relief surface that dimensionally varies from the general configuration of the channel surface. In some such embodiments, the relief surface does not generally conform to the outer surface of the tube. In other embodiments, the relief surface is a recess. In yet further embodiments, the channel defines a plurality of relief surfaces. In some such embodiments, the relief surfaces are spaced from each other in the channel.

In another aspect, the forming bar comprises an elongated portion having a first end and a second end, a first side extending between the first and second ends on one side of the elongated portion, and a second side extending between the first and second ends on another side of the elongated portion opposing the first side. The first side includes a first pair of forming mandrels spaced from each other on said first side that are configured to engage at least a portion of a tube having a first configuration. The second side includes a second pair forming mandrels spaced from each other on said second side that are configured for engaging at least a portion of a tube having a second, different configuration from the first configuration. In some embodiments, the first and second pairs of forming mandrels are adapted for different tubing sizes. In some embodiments, the first side has a plurality of pairs of forming mandrels, each adapted for different tubing configurations or sizes. In further embodiments, the second side also has a plurality of pairs of forming mandrels that are each adapted for different tubing configurations or sizes. In yet further embodiments, the forming mandrels are rotatably mounted to the forming bar, and can be rotated into position to cooperate with the bending mandrel.

In yet another aspect, the holding portion has a quick connect-disconnect mechanism permitting the forming bar to be disconnected from the bender and/or connected to the bender without needing tools to do so. In some embodiments, the mechanism includes a ball detent.

In a further aspect of the invention, a method of using a tubing bender having the above-described forming bar includes:

disconnecting the forming bar from the tube bender;

flipping the forming bar over from one of the first side and the second side to the other of the first side and the second side; and connecting the forming bar to the tube bender.

One advantage of the invention is that a user may utilize different-sized forming mandrels for different size tubing without needing to install separate forming bars or disassembling the forming bar. If a particularly-sized forming mandrel is not located on the side of the forming bar presently installed, the user may merely remove and flip forming bar over to use the forming mandrels located on the other side. In embodiments where the bender has a quick connect-disconnect mechanism, this may be accomplished without the need for tools or removing cumbersome screws, bolts or nuts. Another advantage of the invention is that the relief surfaces of the bending mandrel reduce friction and help prevent the tube from become jammed or difficult to remove from the mandrel after bending.

These and other objects and advantages of the present invention, and/or of the currently preferred embodiments thereof, will become more readily apparent in view of the following detailed description and accompanying drawings.

DETAILED DESCRIPTION OF EMBODIMENTS OF THE INVENTION

Figure 1:
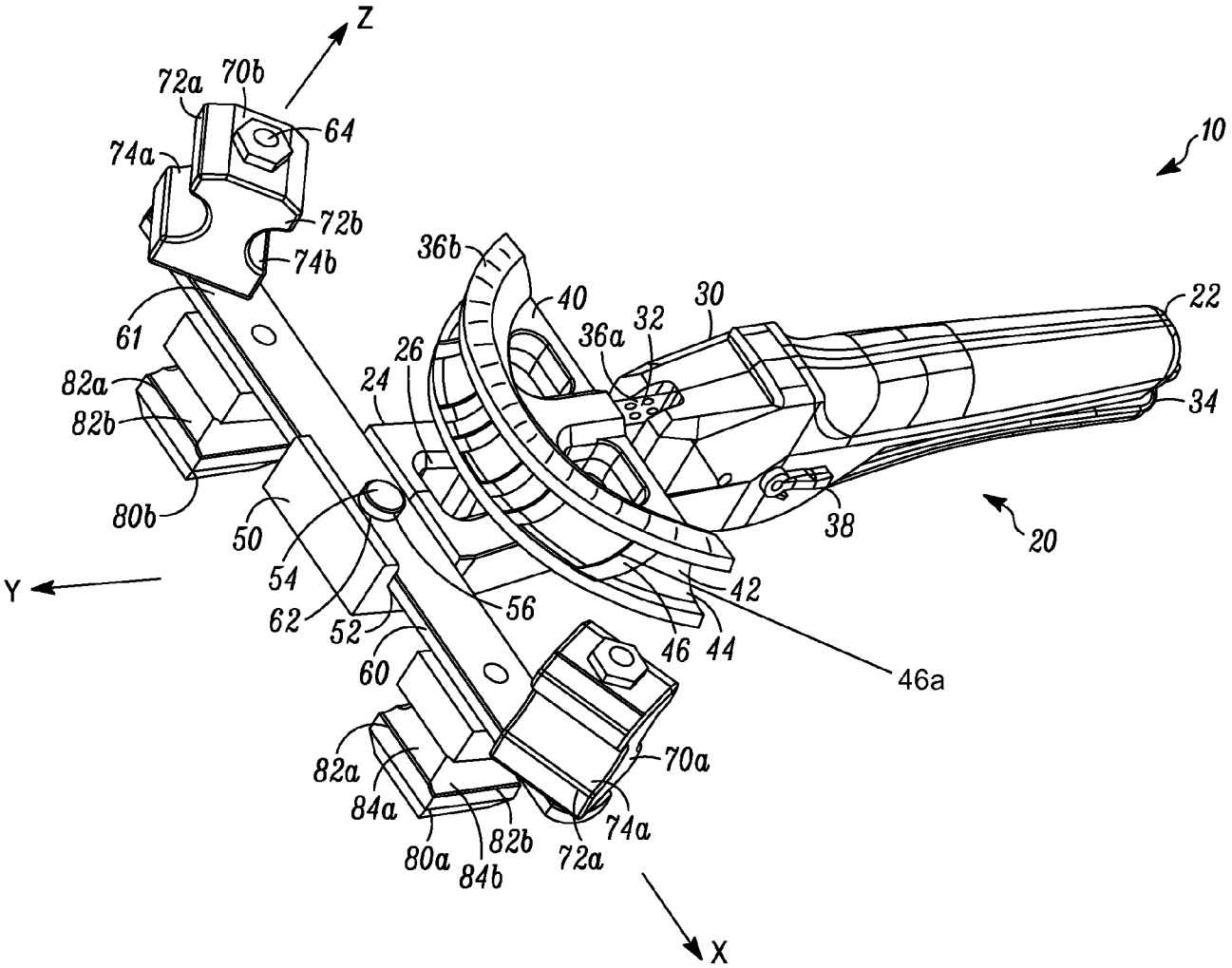
FIG. 1 is a side perspective view of a first embodiment of a crossbow bender.

In FIG. 1, a tubing bender indicated generally by the reference numeral 10 has a base portion 20 and a cross bar or forming bar 60. The words "tubing" or "tube" as used herein should be understood to mean tubing, such as, for example, copper, aluminum, steel, stainless steel, or other metal tubing, or tubing made with a non-metallic material, piping being made out of any material, a rod material, or any other workpiece onto which it is desired to impart a bend or curve. Further, these terms should be understood to refer to work pieces having any shape or cross-section, e.g., round, oval, rectangular, square, solid, etc.

The base portion 20 has a handle portion 22 at one end generally shaped to be held by a user to hold the bender 10, and a holding portion 50 at an end opposite the handle portion. Between the handle portion 22 and holding portion 50 is a guide portion 24. As seen in FIG. 1, the guide portion 24 has a cavity 26. The cavity reduces the amount of material of the base portion 20, reducing cost and weight of the bender 10, and in some embodiments improving the balance of the bender 10.

The base portion 20 is made of a suitable material to withstand the forces of bending. One of ordinary skill in the art should recognize that the base portion 20 may be made of any suitable materials depending on the application, including, but not limited to steel, aluminum or other metals, plastics, and composites. One of ordinary skill in the art should also recognize that the base portion 20 may be constructed of one or more parts, and those parts may be fabricated by any suitable method. Such fabrication methods include, but are not limited to forging, casting, and molding.

The base portion 20 includes an actuator 30 that actuates an actuator member 32, in an actuation direction Y. The actuator 30 is actuated by the user moving an actuator handle 34 from a first position to a second position. In FIG. 1, the actuator handle 34 is shown in the first position and is moved toward the handle portion 22 to the second position.

The actuator 30 is constructed as is known actuators so as to advance the actuator member 32 in the actuation direction Y, while preventing the actuator member 32 from moving toward the handle portion 22. In some embodiments, the actuator 30 includes a ratchet mechanism. In some embodiments, the actuator 30 includes a hydraulic or air cylinder that is pressurized by the user actuating the actuator handle 34. Those of ordinary skill in the art should appreciate, however, that any suitable actuator may be used with the invention. The actuator 30 has a lock/release mechanism or lever 38 to lock and unlock the actuator 30 in a known manner and permit movement of the actuating member 32 toward the handle portion 22 and away from the holding portion 50.

The actuator member 32 is sufficiently strong to resist excessive flexing or bending, or breaking under the stress placed on it during bending. In the illustrated embodiment, the actuator member 32 is a rod. However, those of ordinary skill in the art will understand that the actuator member 32 may take any suitable form.

The end of the actuator member 32 is adapted to releasably receive a bending mandrel, bending former or shoe 40. Those skilled in the art will understand how to achieve this. The bending mandrel 40 has a bending channel 42 with a contour surface 44 shaped and dimensioned to generally conform to the outer surface of a tube to be bent. The bending channel 42 generally defines the bend profile of the tube, e.g., is curved, to form the curve of the tube when the tube is deformed into the bending channel 42 during bending. As is known, different tube sizes utilize different bending mandrels. Thus, the bending mandrels and actuator member 32 are configured, as in known manners, so that the bending mandrel 40 is securely attachable to the actuator member 32 for bending, and then removable for replacement with a different bending mandrel.

The actuator member 32 has one or more indications **36*a* along its length indicating or correlating to the amount the actuator member 32 has been extended in the actuation direction Y to the amount of bend placed on the tube, e.g., the degree of bend. In some embodiments, the indications 36*a* define a graduated scale. The bending mandrel 40 also has indications 36*b* indicating to the user the degree of bend. In some embodiments, only one of the actuator member 32 and the bending mandrel 40** have indications. In other embodiments neither have indications.

The bending channel 42 has a plurality of relief surfaces 46. The relief surfaces 46 define localized dimensional variations, recesses or depressions in the bending channel 42 relative to the nominal contour surface 44 of the bending channel 42. In the relief surfaces 46, the channel surface does not conform to the outer surface of the tube. The relief surfaces 46 reduce friction, which, among other benefits, reduces the required bending force, and/or help prevent the bent tube from becoming stuck in the bending channel 42. The relief surfaces 46 reduce the surface contact area between the tube and the bending channel 42 during bending. In the illustrated embodiment, the contour surface 44 has six relief surfaces 46 spaced along the bending channel in a longitudinal direction. Other embodiments of the invention have more or fewer relief surfaces, including, but not limited to, one relief surface, and no relief surfaces. In the illustrated embodiment, the relief surfaces 46 extend transversely across the entirety of contour surface 44 with edges **46*a* oriented substantially perpendicular to the longitudinal axis of the bending channel 42**. In other embodiments of the invention, the relief surfaces have different sizes, shapes and configurations. In further embodiments, the recesses have different configurations from each other.

Those of ordinary skill in the art should understand that the invention is not limited to any particular sizes, shapes and configurations of recesses.

During bending, the portion of the tube that is located on the inside radius of the bend must shorten from its unbent length to form the bend. This can result in distortion or crimping of the tube in this area. This distortion can cause the tube to jam or "stick" in the bending mandrel. The relief surfaces 46 of the present invention provide space to accommodate the tube distortions during bending, helping to prevent or reduce jamming of the tube in the bending mandrel.

The forming bar 60 has an elongated portion 61 with a mounting hole 62 therein. The forming bar 60 has a first set of mandrel blocks 70*a*, 70*b* spaced apart from each other and located toward opposite ends of the forming portion 61 on a first side of the forming bar 60, and a second set of mandrel blocks 80*a*, 80*b* spaced apart from each other located toward opposite ends of the forming portion 61 on a second side of the forming bar that is opposite the first side. The mandrel blocks 70*a*, 70*b*, 80*a*, 80*b* are each mounted to the forming bar 60 by a mandrel pin 64. Each mandrel block 70*a*, 70*b*, 80*a*, 80*b* is rotatably mounted on its respective mandrel pin 64 so that the mandrel blocks 70*a*, 70*b*, 80*a*, 80*b* are rotatable around an axis extending in the Z direction, which is perpendicular to Y direction Each of the first set of mandrel blocks 70*a*, 70*b* contains a first forming mandrel 72*a* defining a first forming channel 74*a* generally conforming to the outer surface of a first tubing size and/or configuration, and a second forming mandrel 72*b* defining a second forming channel 74*b* generally conforming to the outer surface of a second tubing size and/or configuration. Thus, the first forming channels 74*a* can be utilized for one tubing size, and the second forming channels 74*b* can be utilized for another tubing size.

Similarly, each of the second set of mandrel blocks 80*a*, 80*b* contains a third forming mandrel 82*a* defining a third forming channel 84*a* generally conforming to the outer surface of a third tubing size, and a fourth forming mandrel 82*b* defining a fourth forming channel 84*b* generally conforming to the outer surface of a second tubing size and/or configuration. Thus, the third forming channels 84*a* can be utilized for one tubing size, and the fourth forming channels 84*b* can be utilized for another tubing size.

In the illustrated embodiment, the first forming channels 74*a*, second forming channels 74*b*, third forming channels 84*a* and fourth forming channels 84*b* are configured for different tubing sizes, which correspond to various tubing sizes of the bending mandrels 40. For example, the first forming channels 74*a* can be configured for ⅞" tubing, the second forming channels 74*b* for ¾" tubing, third forming channels 84*a* for ⅝" tubing, and the fourth forming channels for ½" tubing, as indicated on the mandrel blocks 70*a*, 70*b*, 80*a*, 80*b*.

In the illustrated embodiment, each mandrel block 70*a*, 70*b*, 80*a*, 80*b* defines two forming mandrels. However, in other embodiments, a mandrel block can define a fewer or greater number of forming mandrels. In addition, in the illustrated embodiment, each mandrel block 70*a*, 70*b*, 80*a*, 80*b* defines a generally square shape. However, in other embodiments the mandrel blocks 70*a*, 70*b*, 80*a*, 80*b* define other shapes, e.g., triangles, rectangles, etc. In yet other embodiments the first set of mandrel blocks 70*a*, 70*b* define a different shape and number of forming mandrels than the second set of mandrel blocks 80*a*, 80*b*. In such manner, the forming bar 60 can contain the desired number of forming mandrels, eliminating the need to use multiple forming bars for different sizes. In some embodiments, for example, the forming bar 60 can contain forming mandrels for tubing sizes 3⁄16", ¼", 5⁄16", ⅜", ½", ⅝", ¾" and ⅞".

In the illustrated embodiment the forming mandrels 72*a*, 72*b*, 82*a*, 82*b* contain markings 90 identifying the mandrel size. The markings are color-coded for enhanced visual identification of mandrel size.

The holding portion 50 of the base portion 20 defines a holding channel 52 configured and dimensioned to receive the forming bar 60 therein. The holding channel 52 extends generally in the X-direction that is substantially perpendicular to the actuation direction Y so as to maintain the forming bar 60 generally perpendicular to the actuation direction Y. The holding channel 52 is dimensioned so as to substantially prevent movement of the forming bar 60 in the Y direction.

The holding channel 52 is further located on the holding portion 50 and configured to position the forming mandrels 72*a*, 72*b*, 82*a*, 82*b* at the same position, during bending, in the Z direction, which is perpendicular to both the Y and X directions, as the bending mandrel 40. That is, the forming mandrels being used and the bending mandrel 40 are located in the same XY plane.

The holding portion 50 defines a mounting pin 54 located in the holding channel. The mounting pin 54 is configured and dimensioned so as to be received by the mounting hole 62 without excessive play. The mounting pin substantially prevents movement of the forming bar 60 in the X-direction while mounted in the holding channel 52.

The mounting pin 54 includes a holding mechanism 56 for releasably retaining the forming bar 60 in the holding channel 52. The holding mechanism 56 is located and configured to prevent undesired movement of the forming bar 60 in the Z-direction, i.e., out of the channel. Accordingly, the holding channel 52, pin 54, and holding mechanism 56 adequately restrain movement of the forming bar 60 during bending. Conversely, the holding mechanism 56 is preferably configured to allow intentional removal of the forming bar 60.

In the illustrated embodiment, the holding mechanism 56 is a quick connect-disconnect. In some embodiments of the invention, the holding mechanism 56 includes a ball detent. Other embodiments utilize other holding mechanisms, the construct of which should be appreciated by those of ordinary skill in the art.

In the illustrated embodiment, and embodiments having a ball detent or like retaining mechanism, the forming bar 60 can be relatively easily removed from the holding channel 52 without the need for tools or removing a screw or bolt. Moreover, when different tubing sizes are used, the additional forming mandrels on the opposite side of the forming bar 60 can be used. This avoids the need to locate and install a different forming bar or disassemble and re-arrange the forming bar as in previous benders.

Figure 2:
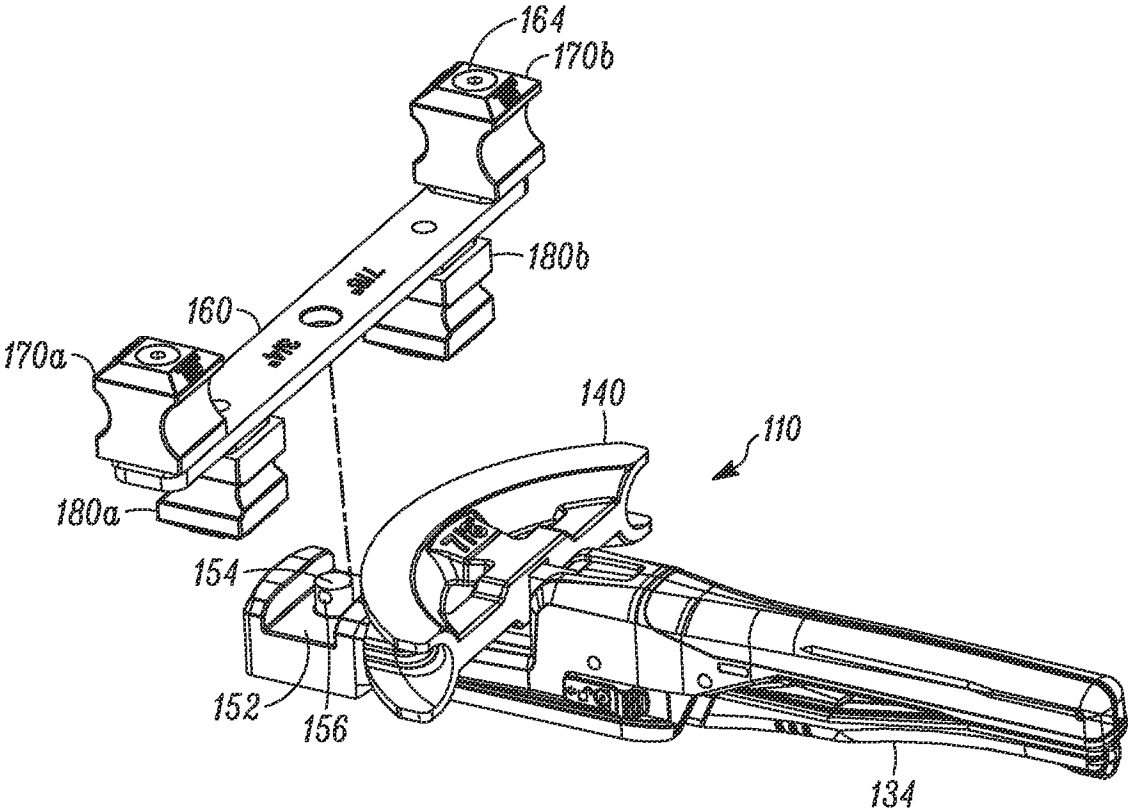
FIG. 2 is a schematic depiction of removing the forming bar from the bender base.
Figure 3:
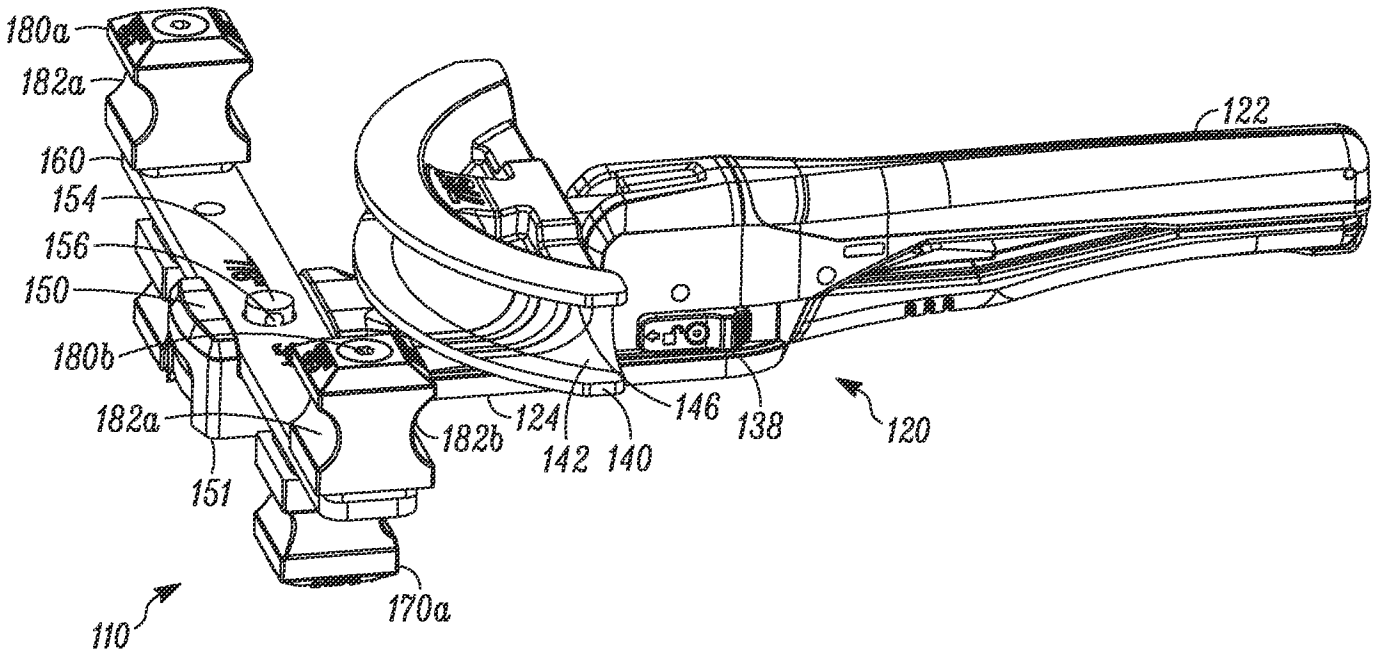
FIG. 3 is a side perspective view of a second embodiment of a crossbow bender embodying the present invention.

FIGS. 2-7 show another embodiment of a bender indicated generally by the reference numeral 110. The bender 110 is substantially similar to the bender 10 described above with reference to FIG. 1, and therefore like reference numerals preceded by the numeral "1" are used to indicate like elements. FIG. 2 schematically depicts the procedure for using forming mandrels located on an opposite other side of the forming bar 160. The user removes the forming bar 160 off the mounting pin 154 and out of the holding channel 152, flips the forming bar 160 over, and places the forming bar 160 back onto the mounting pin 154 so that the holding mechanism 156 retains the forming bar 160 in the holding channel 152.

In operation, a user selects the appropriate bending mandrel 140 for a tubing size and attaches it to the actuator member 132. The user then selects the correspondingly-sized forming mandrels on the forming bar 160 by rotating the forming mandrels until they face the bending mandrel 140. The tube to be bent is placed flush against the selected forming mandrels. In the case of a straight tube, the placed tube extends generally perpendicular to the actuating direction Y of the bender 110.

The user then actuates the actuator 130 by operating the actuating handle 134. This causes the actuator member 132 to extend the bending mandrel 140 toward the forming bar 160 along the guide 124. The guide 124 supports the bending mandrel 140 during actuation. When the bending mandrel 140 extends far enough, the bending channel 142 engages the tube. Upon further extension of the actuator member 132, the bending mandrel 140 pushes the portion of the tube located between the forming mandrels in the actuation direction Y. At the same time, the forming mandrels substantially maintain the Y position of the tube at the location of the forming mandrels. This causes the tube to bend and conform to the contours of the bending channel 142.

As the tube bends around the bending mandrel 140, the forming mandrels rotate around the mandrel pins 164 to maintain contact with the tube.

When the tube is bent to the desired angle, which is indicated on the bending angle indicators (similar to elements 36*a*, 36*b* of FIG. 1), the user stops actuating the actuator 130. The user then operates the actuator lock/release 138 to move the bending mandrel 140 backward and away from the forming bar 160. The bent tube is then removed from the bender 110. Those of ordinary skill in the art will recognize that, depending on the properties of the tube, the tube may exhibit an amount of elastic recovery or "spring-back" after the bending force on the tube is released. Those of ordinary skill in the art will thus understand that the tube may be bent by the bender 110 past the desired bending angle, such that when release the tube will spring back to the desired angle.

Figure 5:
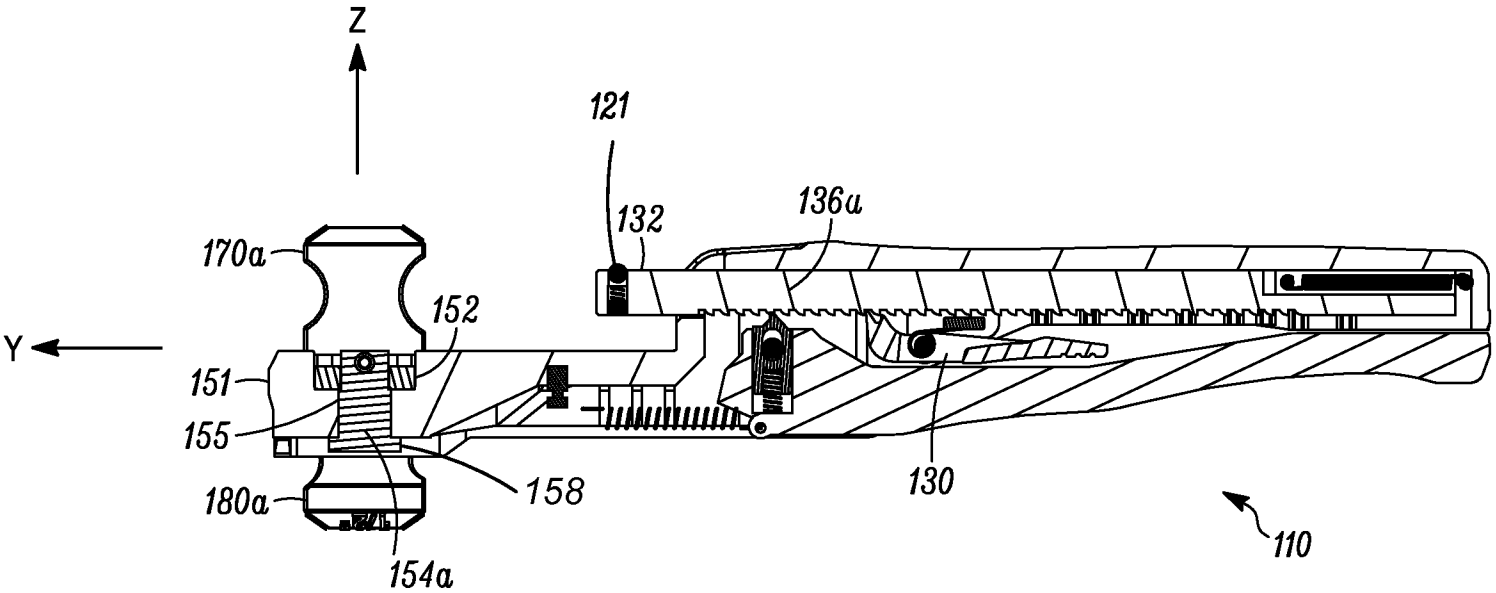
FIG. 5 is a side cross-sectional view of the crossbow bender of FIG. 4 along the line A-A.
Figure 6:
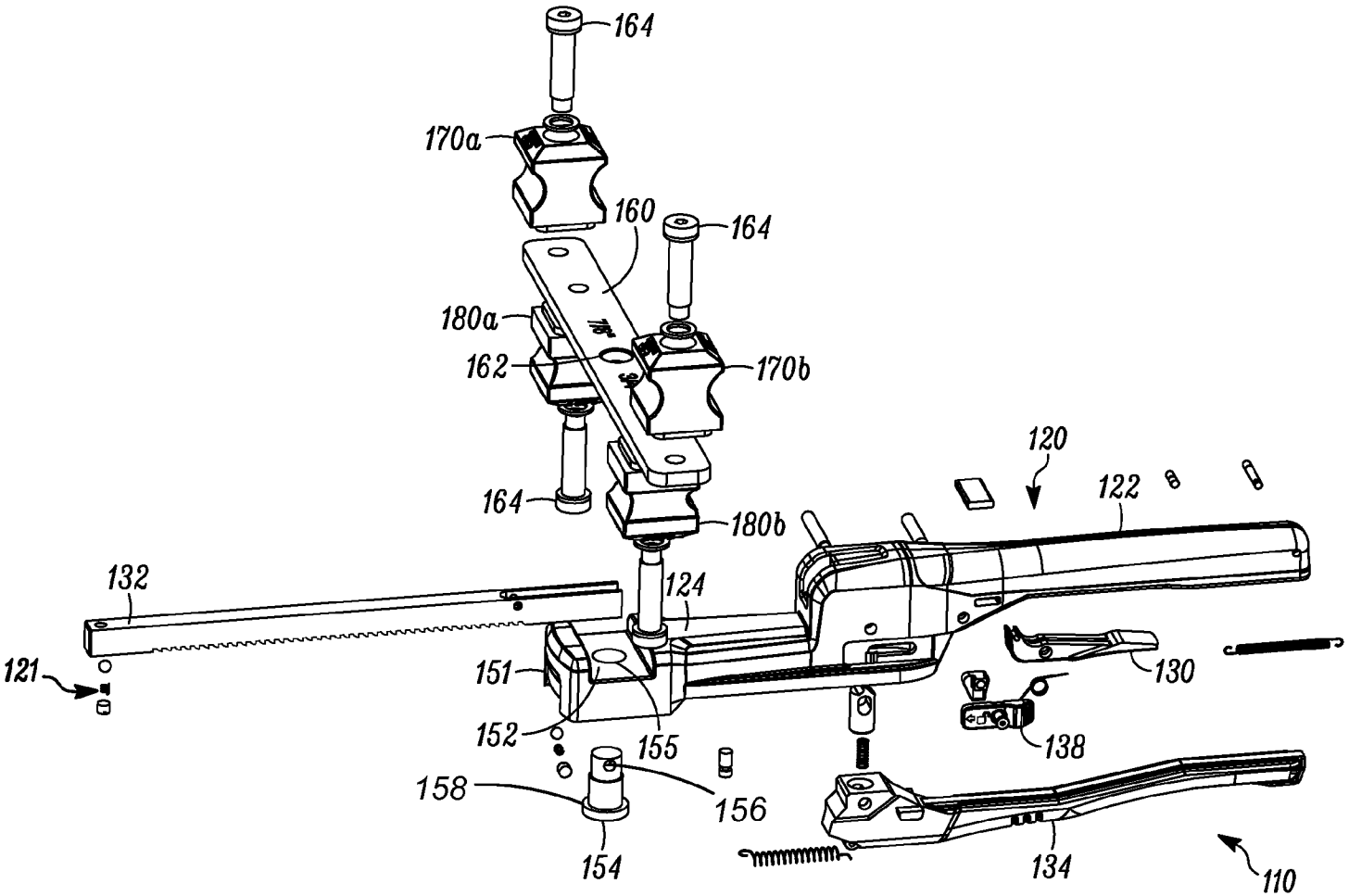
FIG. 6 is an exploded view of the crossbow bender of FIG. 4.
Figure 7:
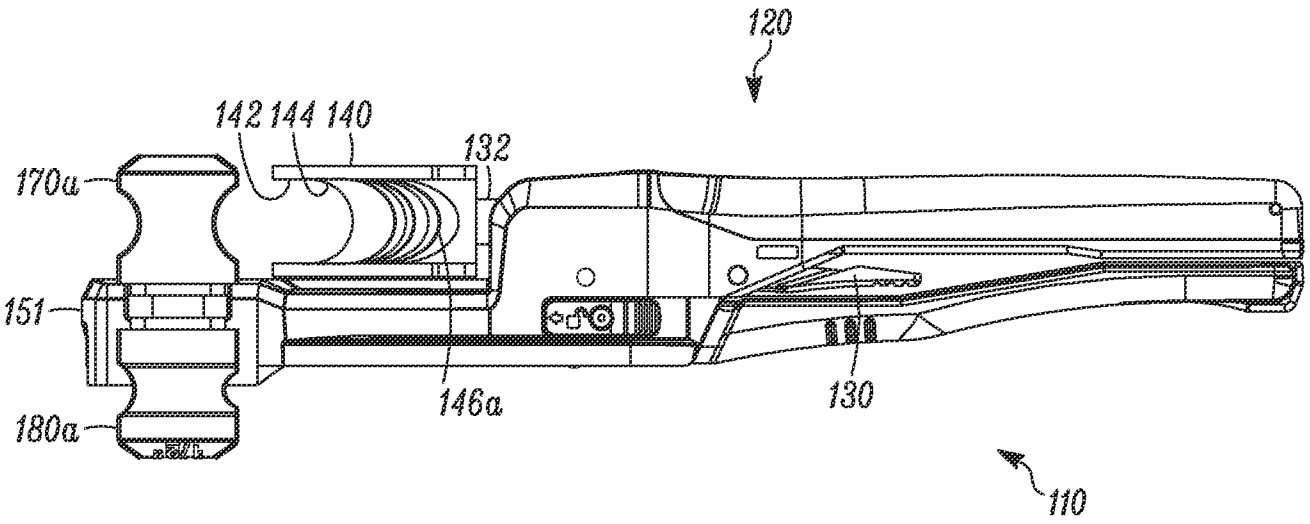
FIG. 7 is a side view of the crossbow bender of FIG. 3.

One difference of the bender 110 in comparison to the bender 10 described above is the mounting pin 154 for securing and releasing the forming bar 160. In the illustrated embodiment, the mounting pin 154 is not solidly mounted to the holding portion 150 as in the embodiment shown in FIG. 1. Instead, as shown in FIGS. 5 and 6, the mounting pin 154 is inserted through a mounting pin slot 155 extending through the holding portion 150 from the rear to the front of the holding portion 150. The mounting pin slot 155 is dimensioned so as to allow the body 154*a* of the mounting pin 154 to be inserted into and removed from the mounting pin slot 155.

One end of mounting pin 154 has a holding mechanism 156, such as, e.g., a ball detent or other securing mechanism, similar to the mounting pin 54 in the embodiment shown in FIG. 1 for securing the forming bar 160 to the holding portion 150. The other end of the mounting pin 154 defines a head 158 dimensioned larger than the dimensions of the mounting pin slot 155 so as to prevent the head 158 from passing into the mounting pin slot 155. Accordingly, the head 158 defines the maximum insertion of the mounting pin 154 into the mounting pin slot 155. The head 158 is spaced from the ball detent a sufficient amount to permit the ball detent to engage the forming bar 160 when inserted through the mounting pin slot 155. At the same time, the head 158 is spaced sufficiently close to the ball detent to hold the forming bar 160 securely against the bottom of the holding channel 152 and prevent excessive play.

To flip the forming bar 160, a user grasps the head 158, by a hand or tool, and pulls the mounting pin 154 out of the mounting pin slot 155 sufficiently toward the rear of the bender 110 to disengage the forming bar 160 from the ball detent. The user then may flip the forming bar 160 over and push the mounting pin 154 back into the mounting pin slot 155 toward the front of the bender until the forming bar 160 is secured to the holding portion 150. In at least some embodiments, the mounting pin 154 can be completely removed from the mounting pin slot 155 for replacement.

In yet other embodiments, the mounting pin 154 takes the form of a screw or bolt, and the mounting pin 154 and the mounting hole 162 of the forming bar 160 have mating threads. In such embodiments, the mounting pin 154 is inserted into the mounting pin slot 155 and threadedly tightened into the mounting hole 162 to secure the forming bar 160. In yet further embodiments, a cotter pin, set screw, or the like maintains the mounting pin 154 in the mounting pin slot 155.

Figure 4:
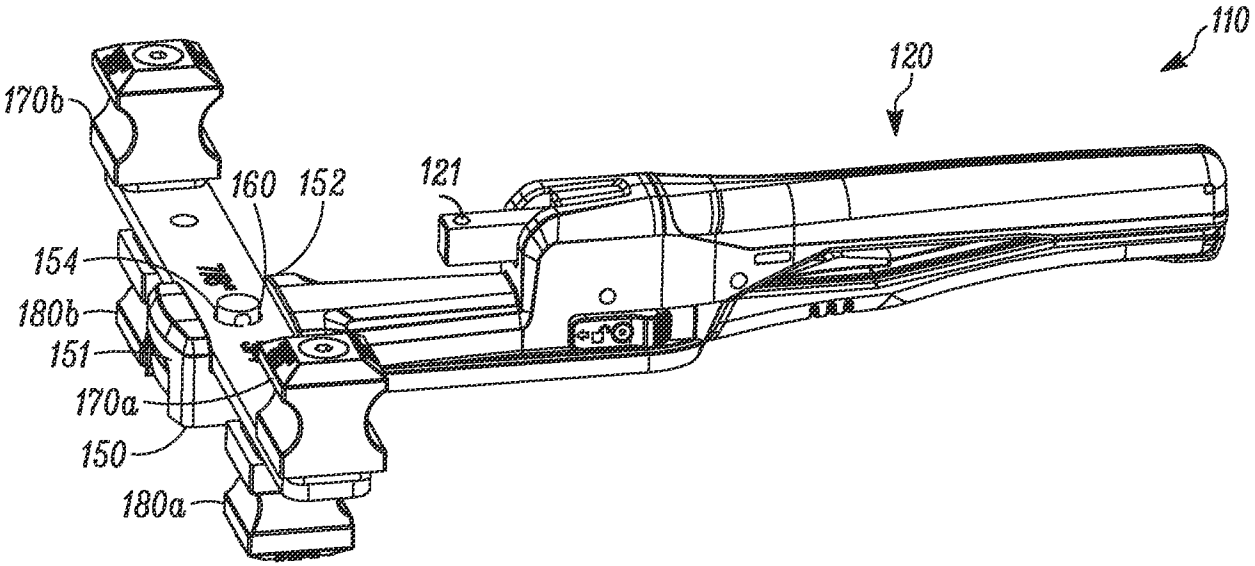
FIG. 4 is a side perspective view of the crossbow bender of FIG. 3 with the bending mandrel removed.

As seen in FIGS. 4-6, the actuator member 132 contains a spring/ball detent mechanism 121 for releasably engaging the bending mandrel 140. The ball is adapted to engage a corresponding detent or recess in the bending mandrel 140 to releasably retain the bending mandrel 140 on the actuator member 132 in a known manner. Those of ordinary skill should understand that any suitable mechanism for retaining the bending mandrel may be used.

Another difference of the bender 110 in comparison to the bender 10 is the shape and configuration of some of the components. For example, the guide portion 124 does not contain a cavity like the bender 10. As another example, the holding portion 150 has a rounded head portion 151, providing additional material near the area of the mounting pin slot 155. The added material helps compensate for the material not present in the mounting pin slot 155. Those of ordinary skill in the art should appreciate further illustrated differences between the embodiments.

As may be recognized by those of ordinary skill in the pertinent art based on the teachings herein, numerous changes and modifications may be made to the above-described and other embodiments of the present invention without departing from its scope as defined in the appended claims. In addition, though the invention may be used for plumbing, heating, cooling, and HVAC applications, it should be understood that the invention may be utilized for other applications as well. Accordingly, this detailed description of currently preferred embodiments is to be taken in an illustrative as opposed to a limiting sense.

What is claimed is:

1. A tube bender comprising:

a forming bar comprising an elongated portion including at least one pair of forming mandrels spaced from each other on said elongated portion configured for engaging a portion of a tube defining a first configuration;

a base portion comprising a holding portion configured to releasably secure the forming bar to the base portion;

wherein the holding portion further comprises a quick connect-disconnect mechanism permitting at least one of (i) disconnection of the forming bar from the base portion without tools; and (ii) connection of the forming bar to the base portion without tools;

an actuator member disposed on the base portion;

a bending mandrel disposed on an end of the actuator member;

an actuator handle configured to actuate the actuator member when operated by a user;

a lock mechanism separate from the actuator handle configured to lock or unlock the actuator member, wherein when locked the lock mechanism prevents movement of the actuator member away from the forming bar but allows for movement of the actuator member toward the forming bar, and wherein when unlocked the lock mechanism allows for movement of the actuator member away from the forming bar.

2. The tube bender of claim 1, wherein the quick connect disconnect mechanism comprises a ball detent.

3. The tube bender of claim 1, wherein the at least one pair of forming mandrels comprises a first pair of forming mandrels installed on a first side of the forming bar, and a second pair of forming mandrels installed on a second side of the forming bar opposite the first side.

4. The tube bender of claim 1, wherein the at least one pair of forming mandrels defines at least one forming channel configured to fit a specific diameter tube.

5. The tube bender of claim 4, wherein the specific diameter tube is selected from the group of tubing sizes consisting of 3/16", 1/4", 5/16", 3/8", 1/2", 5/8", 3/4" and 7/8".

6. The tube bender of claim 4, wherein the at least one pair of forming mandrels comprises a plurality of pairs of forming mandrels, each of said plurality of pairs defining a forming channel configured to fit a specific diameter tube selected from the group of tubing sizes consisting of 3/16", 1/4", 5/16", 3/8", 1/2", 5/8", 3/4" and 7/8".

7. A tube bender as defined in claim 1, wherein the base portion comprises a holding channel configured to receive the forming bar and prevent movement of the forming bar in an axial direction.

8. A tube bender as defined in claim 1, wherein the actuator member comprises a plurality of indications to indicate a degree of bending.

9. A tube bender as defined in claim 1, wherein the bending mandrel comprises:

a curved bending channel configured to receive at least a portion of a tube that is deformed into said bending channel and generally defining a bend profile of the tube;

wherein the bending channel defines a surface generally conforming to the outer surface of the tube; and wherein the bending channel defines at least one relief surface defining a dimensional variation from the generally conforming surface, and in turn, does not generally conform to the outer surface of the tube.

10. A bending mandrel as defined in claim 9, wherein the at least one relief surface comprises a plurality of relief surfaces.

11. A bending mandrel as defined in claim 10, wherein the plurality of relief surfaces are spaced from each other along the bending channel.

12. A bending mandrel as defined in claim 10, wherein the plurality of relief surfaces are disposed longitudinally along the bending channel.

13. A bending mandrel as defined in claim 10, wherein the plurality of relief surfaces comprise edges oriented substantially perpendicular to a longitudinal axis of the bending channel.

14. A bending mandrel as defined in claim 9, wherein the at least one relief surface defines a recess in the surface of the bending channel.

15. A tube bender as defined in claim 1, wherein the bending mandrel is configured to be releasably engageable with the actuator member.

16. A tube bender as defined in claim 15, wherein the actuator member comprises a second quick connect-disconnect mechanism permitting at least one of (i) disconnection of the bending mandrel from the actuator member without tools; and (ii) connection of the bending mandrel to the actuator member without tools.

17. A tube bender as defined in claim 16, wherein the second quick connect-disconnect mechanism comprises a ball detent.

18. A tube bender as defined in claim 1, further comprising an actuator configured to actuate the actuator member along an axis of the base portion.

19. A tube bender as defined in claim 1, further comprising:

a ratchet mechanism configured to be operated by the actuator handle to move the actuator member toward the forming bar when the actuator handle is operated.

* * * * *